US006540267B1

(12) United States Patent
Rohbock et al.

(10) Patent No.: US 6,540,267 B1
(45) Date of Patent: Apr. 1, 2003

(54) BALLOON TIE-AIDING DEVICE

(76) Inventors: David A. Rohbock, 927 E. 500 North, Lehi, UT (US) 84043; Becky C. Rohbock, 927 E. 500 North, Lehi, UT (US) 84043

( * ) Notice: Subject to any disclaimer, the term of this patent is extended or adjusted under 35 U.S.C. 154(b) by 0 days.

(21) Appl. No.: 10/097,469

(22) Filed: Mar. 15, 2002

(51) Int. Cl.[7] ..... D04G 5/00
(52) U.S. Cl. ..... 289/1.2; 289/18.1
(58) Field of Search ..... 289/1.2, 1.5, 17, 289/18.1, 2; 29/257, 259; 81/177.1, 177.8, 487; 248/643; 446/220, 222; 114/218

(56) References Cited

U.S. PATENT DOCUMENTS 2,469,443 A * 5/1949 Reiter ..... 114/218
4,846,803 A * 7/1989 Emerson ..... 206/365
4,903,929 A * 2/1990 Hoffman ..... 24/335
D308,627 S * 6/1990 Guffey ..... D8/356
4,989,906 A * 2/1991 Peverley ..... 289/17
5,039,142 A * 8/1991 Muma ..... 289/17
5,586,378 A * 12/1996 Smith ..... 269/249
5,611,578 A * 3/1997 Angelico et al. ..... 289/17
5,647,615 A * 7/1997 Messier ..... 289/17
6,227,580 B1 * 5/2001 Sundby ..... 289/17

* cited by examiner

*Primary Examiner*—Gary L Welch

(57) ABSTRACT

A balloon tie-aiding device for allowing users to easily and quickly tie balloons. The balloon tie-aiding device includes a clamping assembly being adapted to be fastenably mounted to a support structure such as a work bench; and also includes a pair of finger-like support members being attached to the clamping assembly and being spaced parallel relative to one another with the pair of finger-like support members being adapted upon which a balloon is wrapped thereabout for the tying thereof.

3 Claims, 3 Drawing Sheets

BALLOON TIE-AIDING DEVICE

BACKGROUND OF THE INVENTION

1. Field of the Invention

The present invention relates to balloon tying aids and more particularly pertains to a new balloon tie-aiding device for allowing users to easily and quickly tie balloons.

2. Description of the Prior Art

The use of balloon tying aids is known in the prior art. More specifically, balloon tying aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,611,578; U.S. Pat. No. 5,647,615; U.S. Pat. No. 6,227,580; U.S. Pat. No. 4,989,906; U.S. Pat. No. 5,039,142; and U.S. Pat. No. Des. 308,627.

While these devices fulfill their respective, particular objectives and requirements, the aforementioned patents do not disclose a new balloon tie-aiding device. The prior art describes inventions having a support member and prongs extending therefrom.

SUMMARY OF THE INVENTION

The general purpose of the present invention, which will be described subsequently in greater detail, is to provide a new balloon tie-aiding device which has many of the advantages of the balloon tying aids mentioned heretofore and many novel features that result in a new balloon tie-aiding device which is not anticipated, rendered obvious, suggested, or even implied by any of the prior art balloon tying aids, either alone or in any combination thereof. The present invention includes a clamping assembly being adapted to be fastenably mounted to a support structure such as a work bench; and also includes a pair of finger-like support members being attached to the clamping assembly and being spaced parallel relative to one another with the pair of finger-like support members being adapted upon which a balloon is wrapped thereabout for the tying thereof. None of the prior art describes a combination of the clamping assembly and the finger-like support members being attached to the clamping assembly.

There has thus been outlined, rather broadly, the more important features of the balloon tie-aiding device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new balloon tie-aiding device which has many of the advantages of the balloon tying aids mentioned heretofore and many novel features that result in a new balloon tie-aiding device which is not anticipated, rendered obvious, suggested, or even implied by any of the prior art balloon tying aids, either alone or in any combination thereof.

Still another object of the present invention is to provide a new balloon tie-aiding device for allowing users to easily and quickly tie balloons.

Still yet another object of the present invention is to provide a new balloon tie-aiding device that eliminates a user's finger from getting caught in the loop of the neck of the balloon as the balloon is being tied.

Even still another object of the present invention is to provide a new balloon tie-aiding device that eliminates the stress and pain placed on the user's fingers while tying balloons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
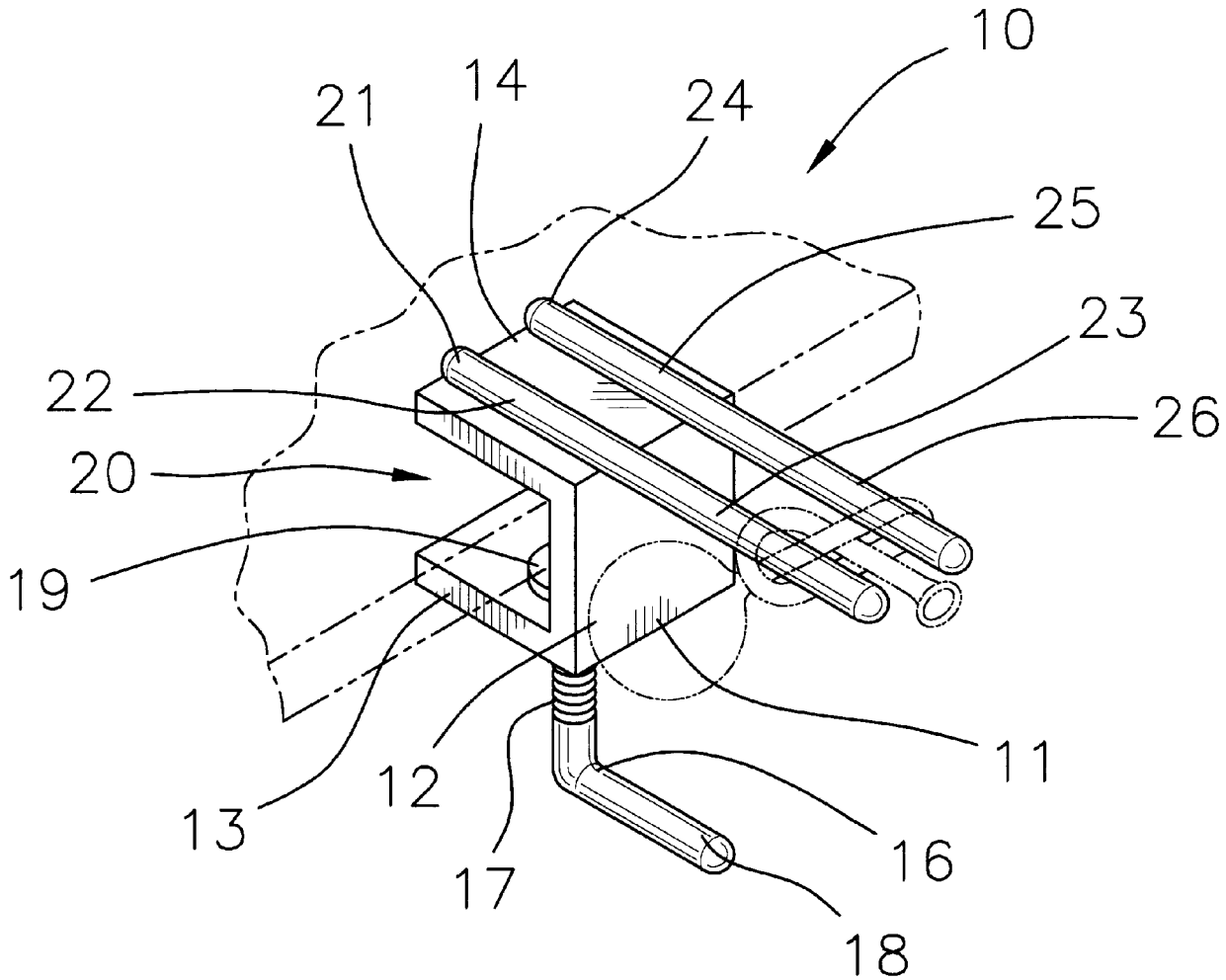
FIG. 1 is a perspective view of a new balloon tie-aiding device according to the present invention and shown in use.
Figure 2:
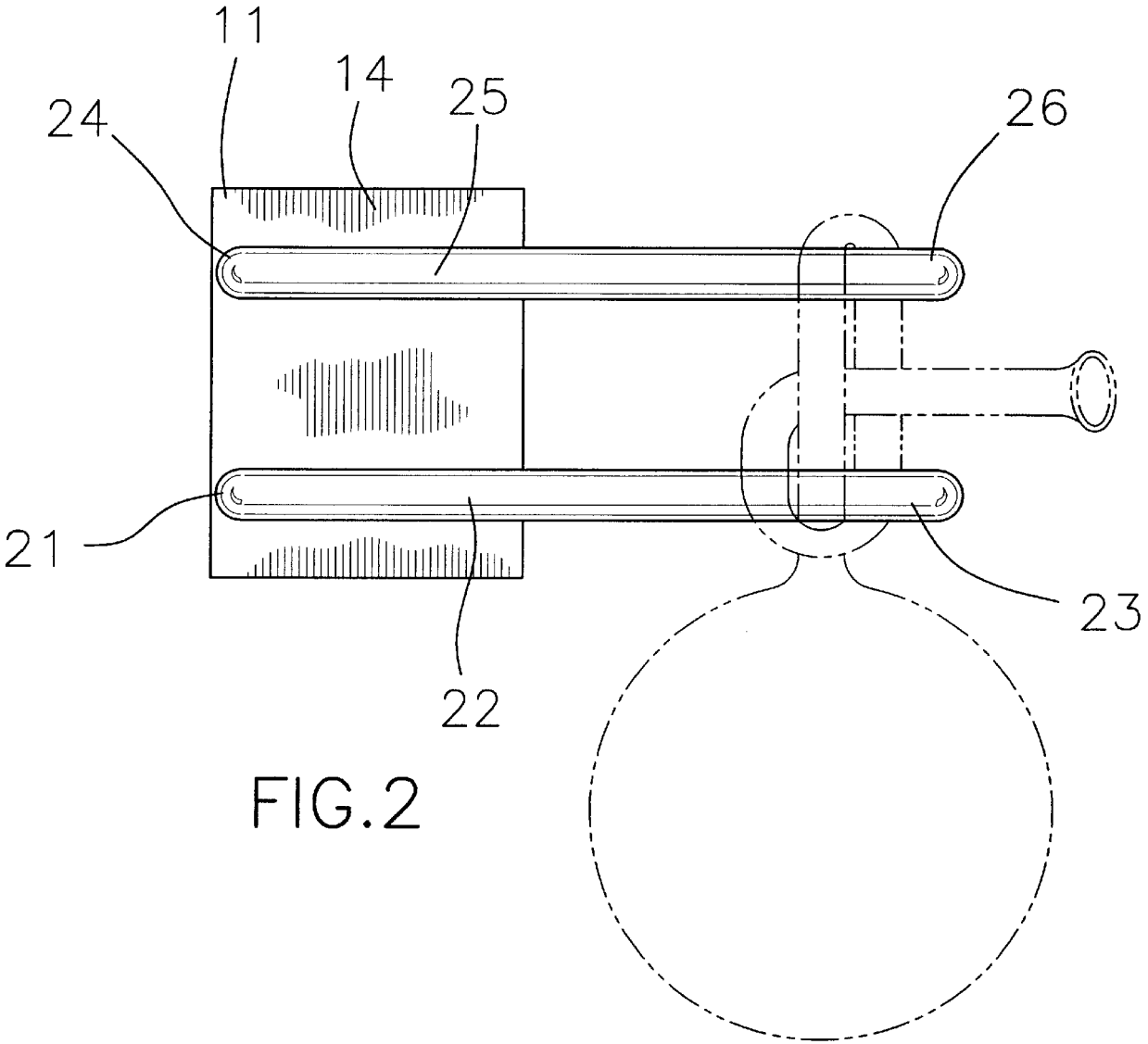
FIG. 2 is a side elevational view of the present invention.
Figure 3:
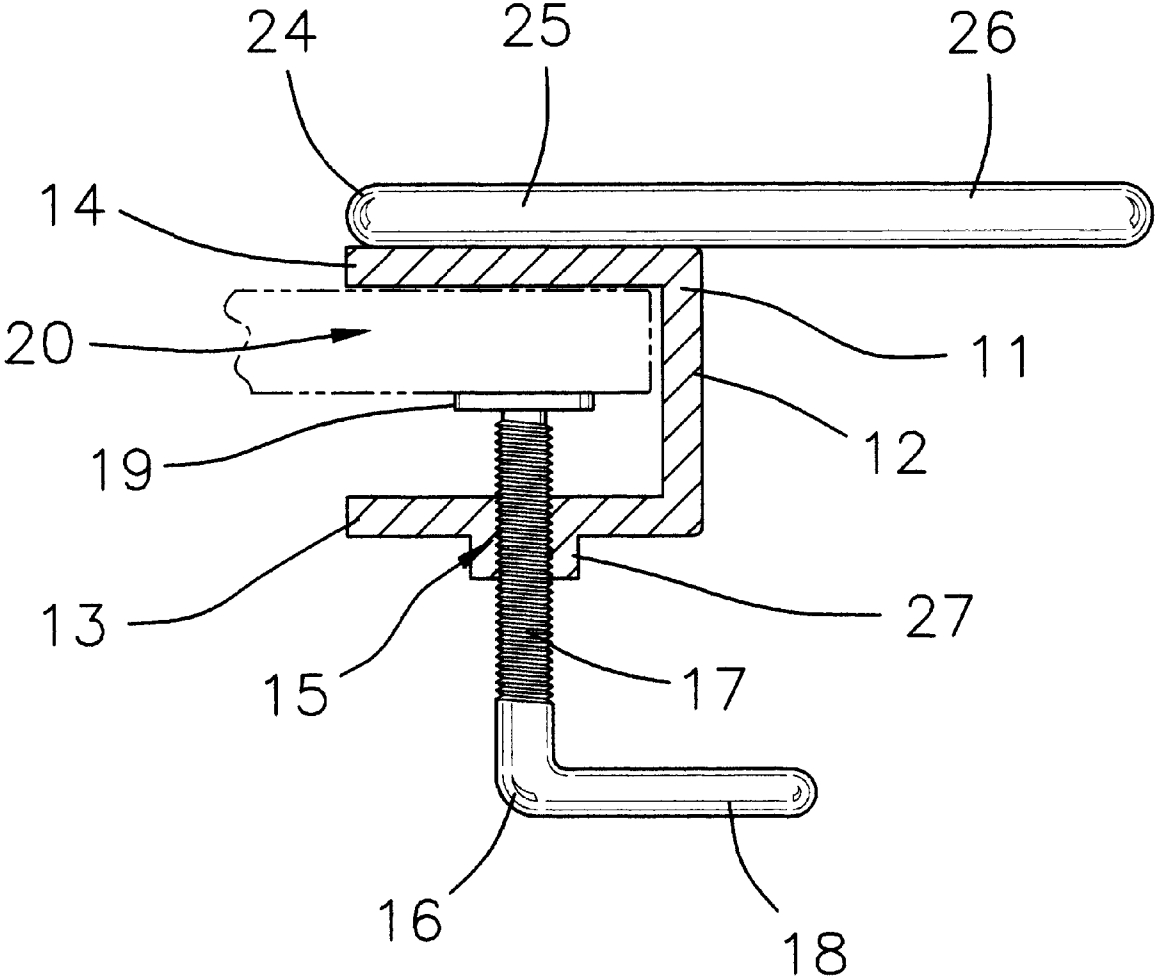
FIG. 3 is a cross-sectional view of the present invention.

With reference now to the drawings, and in particular to FIGS. 1 through 3 thereof, a new balloon tie-aiding device embodying the principles and concepts of the present invention and generally designated by the reference numeral 10 will be described.

As best illustrated in FIGS. 1 through 3, the balloon tie-aiding device 10 generally comprises a clamping assembly being adapted to be fastenably mounted to a support structure such as a work bench. The clamping assembly includes a C-shaped clamp member 11 having a plate-like main portion 12 and first and second plate-like wing portions 13,14 being integrally attached to side edges of the plate-like main portion 11 and extending outwardly generally perpendicular to the plate-like main portion 11 and being spaced parallel relative to one another and forming a slot 20 therebetween for receiving the support structure. The first plate-like wing portion 12 has a has boss 27 being integrally disposed upon an outer side thereof, and also has a threaded bore 15 extending through the boss 27 and the first plate-like wing portion 13. The clamping assembly further includes a fastening member 16 being threaded through the threaded bore 15 and being adapted to engage the support structure for securely mounting the C-shaped clamp member 11 to the support structure. The fastening member 16 includes a threaded shaft 17 being threaded through the threaded bore, and also includes a handle 18 being integrally attached to a first end of the threaded shaft 17, and further includes a disc-shaped contact member 19 being conventionally attached to a second end of the threaded shaft 17 and being disposed in the slot 20 of the C-shaped clamp member 11 for engaging the support structure. The handle 18 is angled generally perpendicular to the threaded shaft 17.

A pair of finger-like support members 21,24 are conventionally attached and welded to the clamping assembly and are spaced parallel relative to one another with the pair of finger-like support members 21,24 being adapted upon which a balloon is wrapped thereabout for the tying thereof. The finger-like support members 21,24 are securely and conventionally attached to an outer side of the second plate-like wing portion 14 and extend generally parallel to the second plate-like wing portion 14. Each of the finger-like support members 21,24 has a first portion 22,25 and a second portion 23,26 with the first portion 22,25 being securely and conventionally attached to the second plate-like wing portion 14 and with the second portion 23,26 extending outwardly and beyond the plate-like main portion 12 of the C-shaped clamp member 11. The finger-like support members 21,24 are essentially rods having parabolic-shaped ends to allow easy removal of a tied balloon.

In use, the user securely clamps the C-shaped clamp member 11 to a work bench, and wraps the neck portion of a balloon filled with air about the second portions 23,26 of the finger-like support members 21,24 to form a loop; whereupon, the user extends the head of the balloon through the loop to tie the balloon.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the balloon tie-aiding device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A balloon tie-aiding device comprising:

a clamping assembly being adapted to be fastenably mounted to a support structure, said clamping assembly including a C-shaped clamp member having a plate-like main portion and first and second plate-like wing portions being attached to side edges of said plate-like main portion and extending outwardly generally perpendicular to said plate-like main portion and being spaced parallel relative to one another and forming a slot therebetween for receiving the support structure; and a pair of finger-like support members being attached to said clamping assembly and being spaced parallel relative to one another and upon which a balloon is wrapped thereabout for the tying thereof, said finger-like support members being securely attached to an outer side of said second plate-like wing portion and extending generally parallel to said second plate-like wing portion.

2. A balloon tie-aiding device as described in claim 1, wherein each of said finger-like support members has a first portion and a second portion, said first portion being securely attached to said second plate-like wing portion and said second portion extending outwardly and beyond said plate-like main portion of said C-shaped clamp member.

3. A balloon tie-aiding device as described in claim 2, wherein are rods having parabolic-shaped ends to allow easy removal of a tied balloon without the balloon getting snagged or ripped.

* * * * *